United States Patent [19]

Huber et al.

[11] Patent Number: 4,903,698

[45] Date of Patent: Feb. 27, 1990

[54] PACIFIER STRAP AND FASTENER FOR ATTACHMENT TO A GARMENT

[76] Inventors: Gloria L. Huber, 10537 Caminito Memosac, San Diego, Calif. 92131; Lawrence L. Lee, 3776 Martha St., San Diego, Calif. 92117

[21] Appl. No.: 325,868

[22] Filed: Mar. 20, 1989

[51] Int. Cl.[4] ..... A61J 17/00

[52] U.S. Cl. ..... 606/235; 24/3 M; 24/17 AD

[58] Field of Search ..... 128/359, 360, ; 24/17 A, 17 AD, 30.55, 336, 300, 301, 305, 545, 563, 564, 3 M; 215/11.1, 100; D24/46

[56] References Cited

U.S. PATENT DOCUMENTS

| | | | |
|---|---|---|---|
| D. 276,939 | 12/1984 | Pascoe | D24/46 |
| 954,066 | 4/1910 | Ware | 128/360 |
| 2,834,350 | 5/1958 | Beck, Jr. et al. | 128/360 |
| 3,112,491 | 12/1963 | Cleveland | 24/300 |
| 3,392,729 | 7/1968 | Lenoir | 128/360 |
| 4,477,950 | 10/1984 | Cisek et al. | 24/30.55 |
| 4,646,394 | 3/1987 | Krauss | 24/30.55 |
| 4,765,037 | 8/1988 | Perry | 128/360 |

*Primary Examiner*—Michael H. Thaler
*Assistant Examiner*—William Lewis
*Attorney, Agent, or Firm*—Baker, Maxham, Jester & Meador

[57] ABSTRACT

A tethering strap for a baby's pacifier, bottle or the like includes an elongated strap having an elastic button at one end for detachable attachment to a pacifier and a clamp and a slit at the other end for detachable attachment to the clothing of an infant.

7 Claims, 1 Drawing Sheet

PACIFIER STRAP AND FASTENER FOR ATTACHMENT TO A GARMENT

BACKGROUND OF THE INVENTION

The present invention relates to tethering devices, and pertains particularly to an improved detachable tethering device for detachable attachment of an infant's pacifier to its garment.

It has long been recognized that it is desirable to prevent an infant's pacifier and/or bottle falling on the floor by attaching it to the infant by some means, such as a string or strap. It is preferable that the tethering string or strap be attached to the infant's garment as opposed to the neck or limb of the infant to avoid cutting off circulation. It is also desirable that the tethering string or strap be such that the infant does not become entangled therein.

Numerous attempts or approaches to solving this problem have been proposed in the past. A number of the prior art devices propose looping a string or strap around the infant's arm or neck. Others recognize the undesirability of this approach and propose attachment of the strap to the infant's clothing to a button or the like. Various means are proposed for attachment to the infant's clothing, such as safety pins, as shown for example in U.K. Patent No. 420,610, dated Dec. 5, 1934. Another approach of interest is that shown in U.S. Pat. No. 3,392,729, issued July 16, 1968 to J. Lenoir. This patent discloses a tethering string attached to a pacifier and to an attachment device which is attached to the clothing of the infant. One form of the attachment device utilizes a stud that presses a portion of the infant's clothing into a spherical recess. Another attachment device is in the form of a disc having a serrated opening through which a portion of the infant's clothing is forced, and then clamped into a housing device in which the disc is threadably engaged.

These approaches are not entirely satisfactory. Accordingly, it is desirable that an improved means for tethering and attaching an infant's pacifier or bottle to the infant be available.

SUMMARY AND OBJECTS OF THE INVENTION

It is the primary object of the present invention to provide an improved means for tethering and attaching an infant's pacifier or bottle to the infant be available. In accordance with the primary aspect of the present invention, a tethering device comprises an elongated strap, with attachment means at one end for attachment to a baby's pacifier or bottle, and attachment means at the opposite end for detachable attachment to the infant's clothing. The attachment means for attachment to the clothing includes an opposing finger clamp wherein opposed fingers clamp to the infant's clothing.

BRIEF DESCRIPTION OF THE DRAWING

The above and other objects and advantages of the present invention will become apparent from the following description when read in conjunction with the drawings wherein.

DETAILED DESCRIPTION OF A PREFERRED EMBODIMENT

Figure 1:
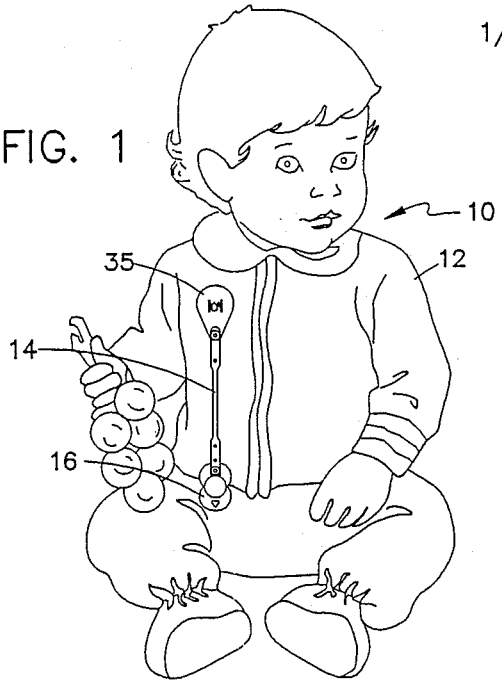
FIG. 1 is a front elevation view showing the invention in operation.

Referring to FIG. 1 of the drawings, there is illustrated an infant, designated generally by the numeral 10, wearing a garment in the form of a shirt or the like 12, to which is attached a preferred embodiment of the invention consisting of a tethering strap 14, to which is attached at one end a conventional pacifier. The pacifier is of conventional construction, with a nipple 15 attached and extending from the concave side of a cupped shell 16 and a knob like handle 17 from the other side. At the other end of the tethering strap 14 is a clothing clip 18 that clips to the clothing or garment 12 of the infant. The strap 14 holds the pacifier to prevent it dropping to the floor when it falls from the infant's mouth. It also keeps it within reach of the infant so that it can be easily retrieved.

The strap is of sufficient length to allow the attachment thereof to the infant's clothing and allow the infant to place the article in his mouth with a certain degree of freedom. However, the strap is kept to a length sufficiently short that it cannot encircle the neck of the infant and entangle therewith. The strap assembly, as disclosed herein, and as will be subsequently described, may also be utilized for holding an infant's bottle.

Figure 2:
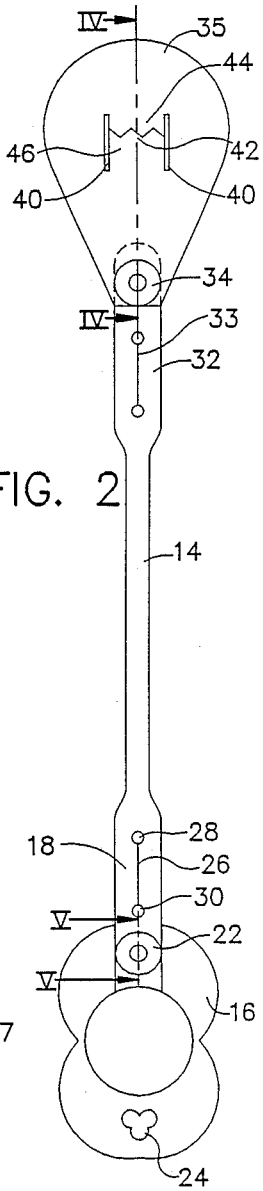
FIG. 2 is a top plan view illustrating a preferred embodiment of the invention.
Figure 4:
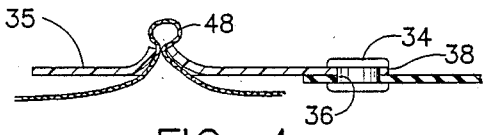
FIG. 4 is a view in section taken on lines IV—IV of FIG. 2.

Referring to FIG. 2 of the drawing, the strap 14 is preferably constructed of a combination rubber-like plastic material, that is non-toxic, flexible, and washable, such as that available under the Trademark "Paracril". This material is available from Warco Company in a white compound or blend of nitrile rubber and polyvinyl chloride plastic that is weather and oil resistant and easily cleaned. Straps of this material will also resist retaining a tight coiling around the finger or arm of an infant. This reduces the likelihood of cutting off circulation if it should become wrapped around an arm or finger. The material is compounded with non-black reinforcing fillers and can be made into a stable white color. The material is available from West American Rubber Company, 750 North Main Street, Orange, Calif.

Figure 5:
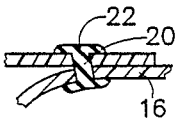
FIG. 5 is a section view taken on lines V—V of FIG. 2.

The strap itself is preferably on the order of about seven inches in length, with a central portion that is preferably approximately one-quarter inch in width, one-sixteenth inch thick, and with opposite ends that are substantially identical and approximately one-half inch in width. The strap is provided at a first end 18, with a bore or aperture 20 in which is mounted a spool-like rubber button 22, which extends through one of a pair of clover leaf shaped holes 24 in the wing of a pacifier 16. The button 22 is shaped as shown in FIG. 5 like a spool with a pair of buttons or disc like ends connected by a smaller diameter shaft therebetween. The button is preferably constructed of a rubber material, such that it can be deformed and forced through the hole, yet has sufficient resistance that it cannot easily be dislodged therefrom.

Figure 6:
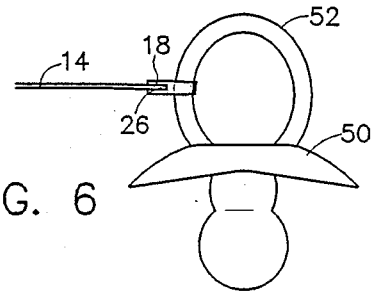
FIG. 6 is a detail view showing an alternate embodiment of the invention.

In addition to the button 22, the end of the strap is provided with a slit 26, which in its preferred form extends between a pair of small diameter holes 28 and 30. A similar slit 33 is preferably formed in the other end of the strap, which can mount over buttons or the like. This enables the end of the strap to be formed in a loop to loop through a ring 52 of another type of pacifier 50, as shown in FIG. 6.

Disposed at the other end of the strap 14 is an enlarged portion 32 having a button or the like 34 extending through a hole 36 and through a hole or bore 38 in a clip-type clamp 35. The end 32 also has a slit 33 that can receive and be attached to a button or a snap on clothing. The clamp 35 in its preferred form, as illustrated, comprises a generally flat, generally tear-drop shaped panel of plastic material having a thickness on the order of about one-thirty second to one-sixteenth of an inch and being somewhat rigid in character.

The clamp 35 is formed of a pair of parallel extending slots 40, which extend through the material, and a connecting slot or cut 42 which extends between the slots 40 and forms serrated ends to a pair of clamp fingers 44 and 46. These fingers 44 and 46 are disposed end to end and tend to lie in a single plane until biased out of that plane by a lateral force thereon. The material from which the clamp is made is a plastic that has a memory and returns to its original position from a deflection.

Figure 3:
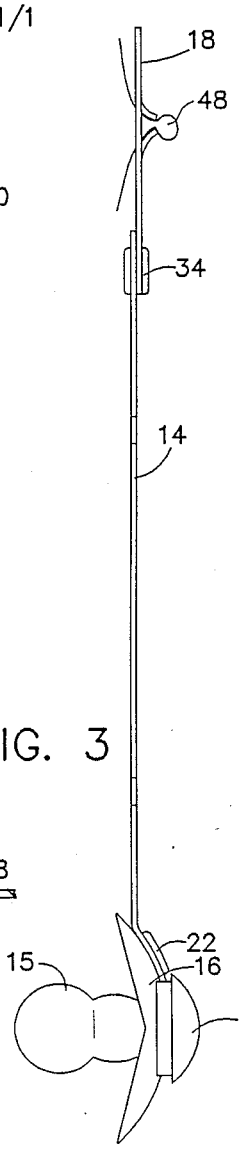
FIG. 3 is a side elevation view of the embodiment of FIG. 2.

The clamp 35 functions, as will be seen in FIG. 3, by the application of a lateral force to open the fingers, and the stuffing for example of a small portion of a piece of clothing between the ends of the fingers 44 and 46. The natural bias of the fingers back to a planar or aligned position forces the ends of the fingers into tight gripping engagement, with the clothing material clamping the unit in place. In order to remove the clamp from the clothing material, the two fingers are biased outward out of alignment sufficient to provide a sufficient gap between the ends thereof to relieve the gripping or clamping force on the cloth material 48. The material 48 may then be withdrawn or removed from the position between the clamping fingers 44 and 46. The clamp 35 can also be used for attachment of other articles and things, such as flowers or the like to clothing.

Referring to FIG. 6, there is illustrated a connection of the strap to a ring type pacifier 50 having a ring 52, serving as a handle or the like. The strap 14 may be looped through the ring 52 at the end 18, with the strap portion 14 looped back through the slot 26 for a looped connection of the strap to the ring type pacifier.

Figure 7:
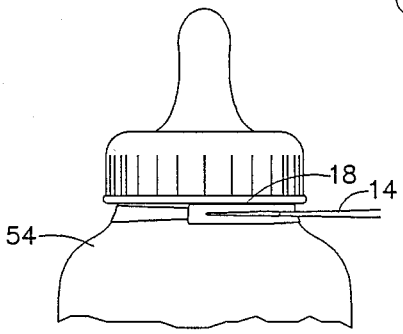
FIG. 7 is a detail view showing a further embodiment of the invention.

Referring to FIG. 7, the end 18 of the strap can be similarly looped around the neck of a conventional baby's bottle 54. In some instances, it may be necessary to provide the strap with additional length in order to loop around the bottle neck. Another modification could include a ring having a suitable hole or aperture through which the button 22 can extend.

Thus, from the above discussion, it is seen that I have provided an improved tethering strap, with detachable attachment means for selectively attaching the ends of the strap to the clothing of an infant, and for holding an infant's pacifier, bottle or the like. In particular, an improved combination pacifier and tethering strap is provided.

While we have illustrated and described our invention by means of specific embodiments, it is to be understood that numerous changes and modifications may be made therein without departing from the spirit and scope of the invention as defined in the appended claims:

We claim:

1. A tether for an infant's pacifier of the like, comprising:

an elongated strap having opposite first and second ends;

first attachment means at said first end for detachable attachment to a pacifier; and opposed finger clip means comprising a flat panel of substantially rigid material having a pair of spaced apart parallel slots extending side by side and connected by an irregular cut at the center thereof for defining a pair of normally aligned opposed fingers with serrated tips lying in the plane of said panel said finger clip means being attached to the second end of said strap for detachable attachment to clothes.

2. A tether for an infant's pacifier or the like according to claim 1 wherein said first attachment means comprises an elactic button for detachable engagement with a opening in a pacifier shell.

3. A tether for an infant's pacifier or the like according to claim 1 further comprising second attachment means on said first end of said strap comprising a slit in said first end of said strap for forming a loop for detachable attachment around a selected one of a pacifier and a neck of a bottle.

4. An infant's pacifier having detachable tethering means, comprising in combination:

an infant's pacifier having a nipple portion and a handle portion;

an elongated strap having opposite first and second ends;

an elastic button at said first end detachably attached to an opening of a shell of said pacifier; and opposed finger clip means comprises a flat panel of substantially rigid material having a pair of spaced apart parallel slots connected by a transverse zigzagged slot at the center thereof for defining a pair of normally aligned fingers having serrated tips disposed end to end for detachable attachment to an infant's clothes; and second attachment means on said first end of said strap comprising a longitudinal slit in said first end of said strap for forming a loop for detachable attachment around a selected one of a handle of a pacifier and a neck of a bottle.

5. An infant's pacifier having detachable tethering means, comprising in combination:

an infant's pacifier having a nipple portion and a handle portion;

an elongated strap of a rubber like plastic material having a center portion of a first width and opposite end portions that are about twice the width of said center portion;

first attachment means at said first end comprising an elastic button for detachable engagement with an opening in a shell of said pacifier; and opposed finger clip means attached to the second end of said strap for detachable attachment to an infant's clothes, said opposed finger clip means comprises a flat panel of substantially rigid material having a pair of spaced apart parallel slots connected by a transverse zigzagged slot at the center thereof for defining a pair of normally aligned fingers disposed end to end.

6. An infant's pacifier according to claim 5 further comprising second attachment means on said first end of said strap comprising a longitudinal slit in said first end of said strap for forming a loop for detachable attachment around a selected one of a handle of a pacifier and a neck of a bottle.

7. An infant's pacifier according to claim 6 wherein said strap is on the order of about seven inches in length, with the center portion about one-quarter inch in width, and the ends about one-half inch in width.

* * * * *